United States Patent [19]

Mohuchy

[11] Patent Number: 4,978,965

[45] Date of Patent: Dec. 18, 1990

[54] BROADBAND DUAL-POLARIZED FRAMELESS RADIATING ELEMENT

[75] Inventor: Wolodymyr Mohuchy, Nutley, N.J.

[73] Assignee: ITT Corporation, New York, N.Y.

[21] Appl. No.: 336,290

[22] Filed: Apr. 11, 1989

[51] Int. Cl.[5] ..... H01Q 1/38; H01Q 21/28

[52] U.S. Cl. ..... 343/727; 343/767; 343/795

[58] Field of Search ..... 343/700 MS File, 727, 343/767, 795, 797

[56] References Cited

U.S. PATENT DOCUMENTS

| | | | |
|---|---|---|---|
| 3,836,976 | 9/1974 | Monser et al. | 343/797 |
| 4,001,834 | 1/1977 | Smith | 343/795 |
| 4,063,248 | 12/1977 | Debski et al. | 343/727 |
| 4,085,406 | 4/1978 | Schmidt et al. | 343/789 |
| 4,298,878 | 11/1981 | Dupressoir et al. | 343/795 |
| 4,573,056 | 2/1986 | Dudome et al. | 343/795 |

FOREIGN PATENT DOCUMENTS

| | | | |
|---|---|---|---|
| 2802585 | 8/1978 | Fed. Rep. of Germany | 343/727 |
| 2048571 | 12/1980 | United Kingdom | 343/797 |

*Primary Examiner*—Michael C. Wimer

*Attorney, Agent, or Firm*—Thomas N. Twomey

[57] ABSTRACT

A dual-polarization radiating element wherein the phase centers of its constituent radiating elements substantially coincide to provide advantageous operation when the inventive dual-polarization radiating elements are utilized to form wide bandwidth, wide scan-angle, phased array antennas. An inventive dual-polarization radiating element is formed from a substantially planar notch radiating element; a substantially planar dipole radiating element which is interlocked with, and disposed in a plane which is substantially orthogonal to, the notch radiating element; and a structural absorber which is affixed to the notch radiating element and the dipole radiating element.

9 Claims, 6 Drawing Sheets

20

30

BROADBAND DUAL-POLARIZED FRAMELESS RADIATING ELEMENT

BACKGROUND OF THE INVENTION

The present invention pertains to the field of RF radiating elements and, in particular, to dual-polarization radiating elements that can be extended via RF control networks to select any desired polarization in space and which are suitable for use in phased array antennas.

It is well known to those of ordinary skill in the art that when dual-polarization radiating elements are utilized to provide a phased array antenna, it is desirable and advantageous for the phase centers of the dual-polarization elements to coincide. In particular, it is also well known to those of ordinary skill in the art that the requirement of phase center coincidence is more important when one fabricates a phased array antenna which is responsive to wide frequency variation or bandwidth than for one of lower bandwidth.

In addition, it is well known to those of ordinary skill in the art that one type of radiating element which may operate with any one of a number of polarizations such as, without limitation, linear polarization, circular polarization, and elliptical polarization, is sometimes referred to as a "double-ridged" horn radiating element. Such a double-ridged horn radiating element has a vertical feed and an independent horizontal feed and the phase centers associated with the feeds are coincident. However, it is well known to those of ordinary skill in the art that to attain a relatively wide scan angle, say of the order of $\pm 60°$ it is generally required that the phase centers of adjacent ones of a plurality of radiating elements in an array be displaced from one another by less than one-half the wavelength. Since, the width of a horn is generally required to be larger than one-half the wavelength, and sometimes even up to the order of one wavelength, to provide efficient matching to free space over a wide frequency variation or bandwidth, it follows that while a double-ridged horn is adapted to operate with radio frequency energy of one of a variety of polarizations, such a radiating element may not be readily used in a phased array antenna having a relatively wide bandwidth and a relatively wide scan angle.

U.S. Pat. No. 3,836,976, issued on Sept. 17, 1974, discloses a closely spaced orthogonal array which attempts to solve the above-described problems associated with fabricating a phased antenna array from double-ridged horn radiating elements. In particular, this patent discloses a phased array antenna which is comprised of a plurality of vertical radiating elements and a plurality of horizontal radiating elements which are arranged in a linear array and which are affixed to a back wall which forms a ground plane for the radiating elements. However, the disclosed phased array antenna suffers several drawbacks. The first drawback of the disclosed phased array antenna is caused by the fact that all the radiating elements are notched flares which are identical and the feeds displaced from one another. As a result, the phase centers for the horizontal and vertical pair from each radiating element in the array do not coincide. As is well know to those of ordinary skill in the art, this creates a problem when the antenna is scanned in a broad band mode. The second drawback of the disclosed structure is caused by the ground plane.

The ground plane causes large reflections of incident signals which can be detrimental in certain applications.

As one can readily appreciate from the above, there is a need in the art for a dual-polarization radiating element which can be used as a single radiating element or which can be combined through an RF device into a variety of phased array configurations: (1) wherein the phase center of each of its constituent radiating elements coincide to provide suitable operation in wide bandwidth, wide scan-angle, phased array antennas and (2) which does not cause large reflections of incident signals therefrom. Additionally, there is a need for such a dual-polarization radiating element which does not suffer from the mechanical cross-over problems which have, up until now, plagued the manufacture of dual-polarization radiating elements.

SUMMARY OF THE INVENTION

Embodiments of the present invention satisfy the above-identified needs in the art by providing a dual-polarization radiating element: (1) which can be used as a single radiating element or which can be combined through an RF device into a variety of phased array configurations and (2) which solves the mechanical cross-over problems which have previously plagued the manufacture of dual-polarization radiating elements. Further, embodiments of the inventive dual-polarization radiating element are comprised of constituent radiating elements wherein the phase centers of the constituent radiating elements substantially coincide to provide advantageous operation when the inventive dual-polarization radiating elements are utilized to form wide bandwidth, wide scan-angle, phased array antennas. Still further, embodiments of the inventive dual-polarization radiating element does not cause large reflections of incident radiation therefrom.

Specifically, an inventive dual-polarization radiating element comprises: (a) a substantially planar notch radiating element; (b) a substantially planar dipole radiating element which is interlocked with, and disposed in a plane which is substantially orthogonal to, the notch radiating element; and (c) a structural absorber means which is affixed to the notch radiating element and the dipole radiating element.

Both the notch radiating element and the dipole radiating element of the inventive dual-polarization radiating element are fabricated from a dielectric material carrier which has: (1) an exterior metallic deposition to provide the respective radiating configurations and (2) an interior excitation means, sometimes referred to as a radiation launching means, to provide means for exciting the respective radiating elements with energy from RF devices or for receiving incident RF energy. As a result, embodiments of the inventive dual-polarization radiating element provide advantages over dual-polarization radiating elements which exist in the prior art. A first advantage of the inventive dual-polarization radiating element occurs because the radiation launching means for a notch radiating element is different from the radiation launching means for a dipole radiating element. As a result, the phase center of the two radiating elements can be made to coincide substantially. This advantageously permits embodiments of the inventive dual-polarization radiating element to be used to provide multi-octave electrical operation with substantially the same phase center for both radiated polarizations. For example, embodiments of the inventive dual-polarization radiating element can be used to fabricate wide bandwidth, such as a bandwidth covering the range of frequencies from 6 GHz to 18 GHz, wide scan-angle, phased array antennas.

A second advantage of the inventive dual-polarization radiating element occurs because embodiments of the inventive dual-polarization radiating element are mounted in a structural absorber rather than on a metallic ground plane as has been the practice in the prior art. As a result, the only metallic surfaces that are visible to incoming radiation for the inventive dual-polarization radiating element are the exterior metallizations, which exterior metallizations are electrically very small. This significantly reduces reflections of incident signals such as incident radar signals.

BRIEF DESCRIPTION OF THE FIGURES

A complete understanding of the present invention may be gained by considering the following detailed description in conjunction with the accompanying drawing, in which.

To facilitate understanding, identical reference numerals have been used to denote identical elements common to the figures.

DETAILED DESCRIPTION OF THE FIGURES

Figure 1:
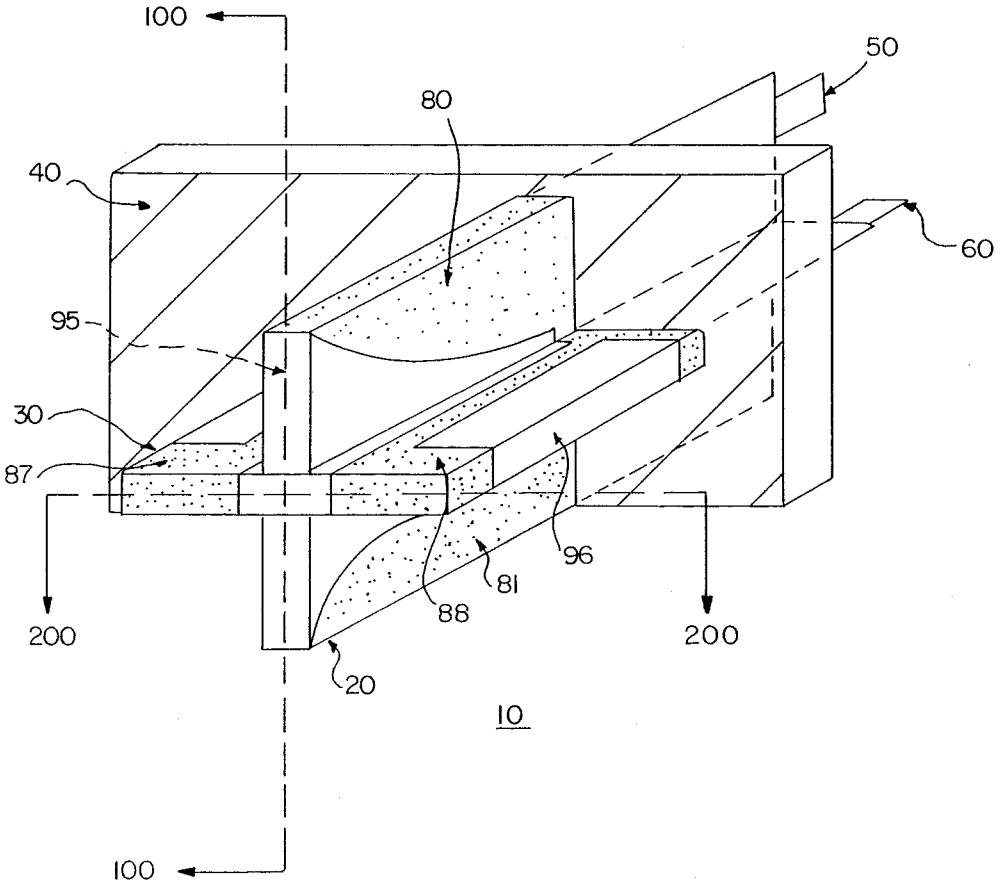
FIG. 1 shows, in pictorial form, a perspective view of a preferred embodiment of the inventive broadband, dual-polarization, frameless radiating element.

FIG. 1 shows, in pictorial form, a perspective view of a preferred embodiment of the inventive broadband, dual-polarization, frameless radiating element 10. Radiating element 10 is comprised of notch radiating element 20, dipole radiating element 30, structural absorber 40, RF reference polarization port 50 and RF orthogonal polarization port 60. Notch radiating element 20 is shown, for convenience, in a vertical arrangement and dipole radiating element 30 is disposed in orthogonal relationship to notch radiating element 20. As will be described in detail below, notch radiating element 20 is formed by placing metallic depositions 80 and 81 on dielectric material carrier 95 and dipole radiating element 30 is formed by placing metallic depositions 87 and 88 on dielectric material carrier 96.

Notch radiating element 20 and dipole radiating element 30 are mounted in structural absorber 40 which may be comprised of many suitable materials well known to those of ordinary skill in the art. Note that this feature of inventive dual-polarization radiating element 10 is different from the structure disclosed in the prior art where, for example, as shown in U.S. Pat. No. 3,836,976, radiating elements are mounted on a metallic ground plane. As a result, in the above-described embodiment of inventive dual-polarization radiating element 10, the only metallic surfaces which are visible to incoming radiation are exterior metallizations 80, 81, 87 and 88, which metal surfaces are electrically small. Consequently, the reflection of incident RF signals is substantially reduced.

RF ports 50 and 60 serve either as transmission inputs or as reception outputs. They are formed, in accordance with methods well known to those of ordinary skill in the art, for compatibility with connecting devices and with notch radiating element 20 and dipole radiating element 30, respectively. Further, RF ports 50 and 60 can be fabricated from any transmission line which is desired.

Figure 2:
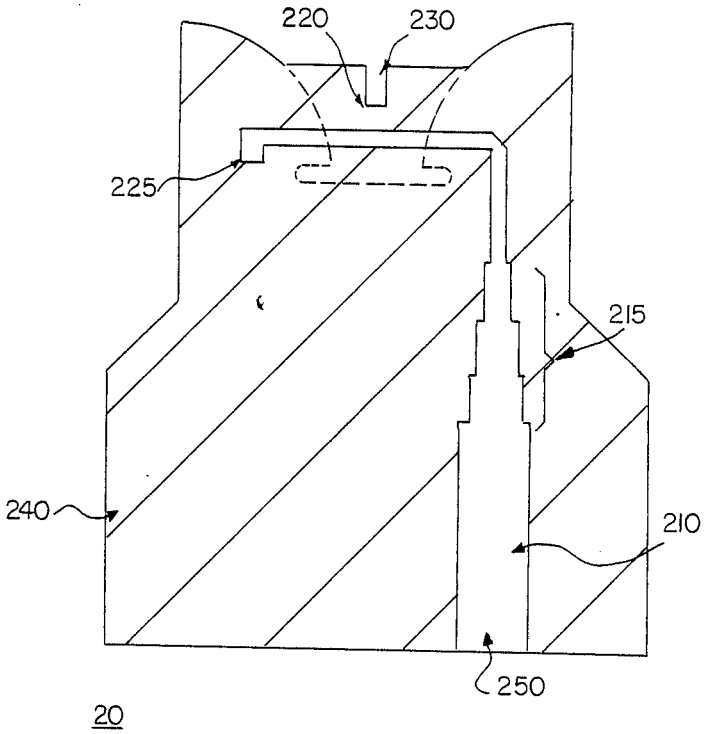
FIG. 2 shows, in pictorial form, an interior cross section of the notch radiating element of the inventive dual-polarization radiating element.

FIG. 2 shows, in pictorial form, an interior cross section of notch radiating element 20 of inventive dual-polarization radiating element 10 which corresponds to a slice taken through dielectric material carrier 95 and viewing the resultant slice in the direction of arrows 100.

Dielectric material carrier 95 may be fabricated from many materials which are well known to those of ordinary skill in the art such as, without limitation, Teflon fiber glass, Duroid, and so forth, and may have a thickness of approximately 0.032". As shown in FIG. 2, coax-to-stripline transducer 210 is formed in accordance with methods which are well known to those of ordinary skill in the art to provide a phase center substantially at point 220. Transducer 210, often referred to in the art as a balun or as an exciter, is comprised, in this embodiment, of a three stage transformer 215 and is further comprised of tuning reactance 225. Further, as shown in FIG. 2, surface 240 is comprised of the material of dielectric material carrier 95.

Slit 230 is provided, as will become clear below, to provide support for dipole radiating element 30 when notch radiating element 20 and dipole radiating element 30 are interlocked at substantially 90° with respect to each other. Lastly, as shown in FIG. 2, RF energy is applied from RF reference polarization port 50 to transducer 210 substantially at position 250.

Figure 3:
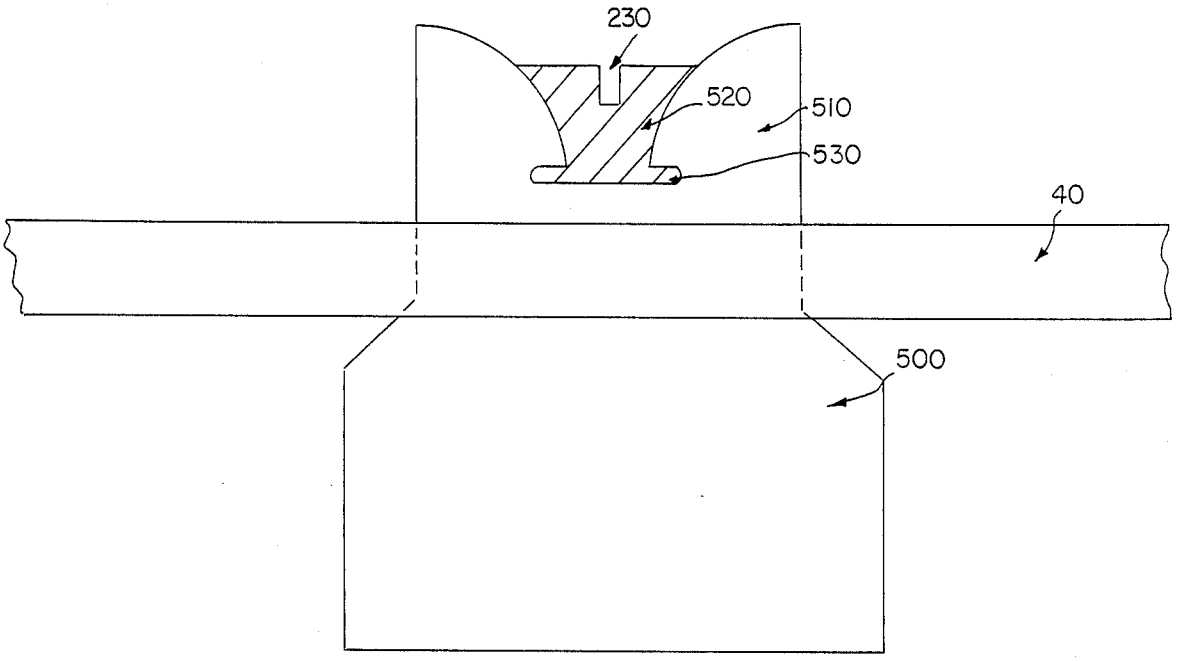
FIG. 3 shows, in pictorial form, an exterior view of the notch radiating element of the inventive dual-polarization radiating element.

FIG. 3 shows, in pictorial form, an exterior view of notch radiating element 20 of inventive dual-polarization radiating element 10 which corresponds to a view along the direction of arrows 100. FIG. 3 also shows where absorber 40 is disposed in relation to notch radiating element 20.

As shown in FIG. 3, surface 500 of notch radiating element 20 is covered with a conductor such as, for example, copper. Please note that the opposite surface of notch radiating element 20 is substantially identical to the surface shown in FIG. 3. Surface 500 serves as part of the electrical connection when RF energy is applied to transducer 250 and, for example, a ground is applied to surface 500. Thus, the portion of notch radiating element 20 which includes surface 500 and which extends behind absorber 40, serves as a portion of RF reference polarization port 50.

Further, as shown in FIG. 3, surface 510 is conductive, for example, copper, and is formed, in accordance with methods well known to those of ordinary skill in the art, to have a shape which provides a notch radiating element. FIG. 3 also shows an illustrative design which provides dimensions of the various components of notch radiating element 20 in a preferred embodiment. Lastly, as is well known to those of ordinary skill in the art, surface 520 is formed from dielectric material carrier 95 and slot 530 is a tuning slot for notch radiating element 20.

Figure 4:
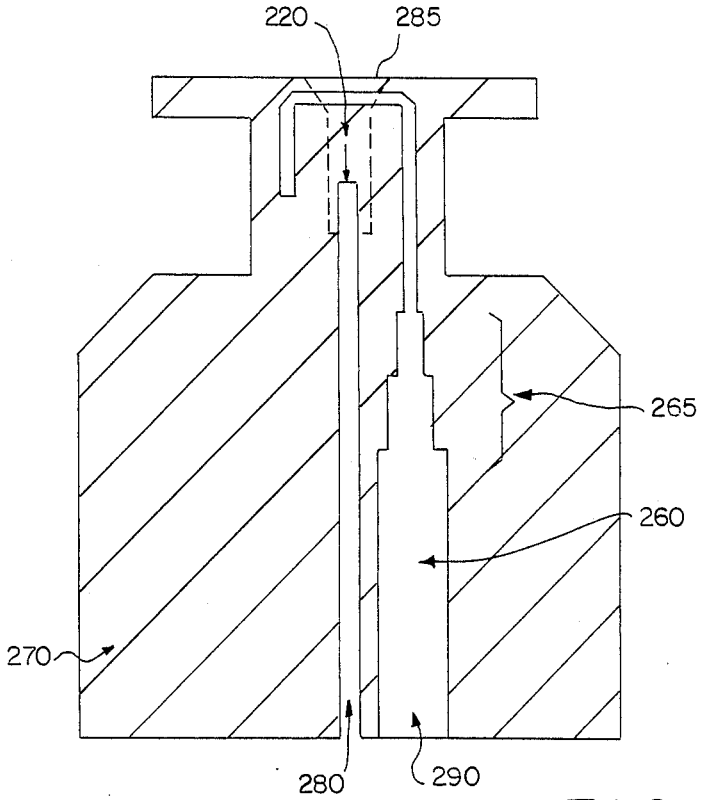
FIG. 4 shows, in pictorial form, an interior cross section of the dipole radiating element of the inventive dual-polarization radiating element.

FIG. 4 shows, in pictorial form, an interior cross section of dipole radiating element 30 of inventive dual-polarization radiating element 10 which corresponds to a slice taken through dielectric material carrier 96 and viewing the resultant slice in the direction of arrows 200.

Dielectric material carrier 96 may be fabricated from many materials which are well known to those of ordinary skill in the as, without limitation, Teflon fiber glass, Duroid, and so forth, and may have a thickness of approximately 0.032". As shown in FIG. 4, coax-to-stripline transducer 260 is formed in accordance with methods which are well known to those of ordinary skill in the art to provide a phase center at point 220. Thus, as one can readily appreciate, due to the differences in configurations of coax-to-stripline transducers 210 and 260, the phase centers for notch radiating element 20 and for dipole radiating element 30 are substantially the same, i.e., the phase centers for both radiating elements substantially coincide. Further, as was discussed above, this advantageously permits one to use inventive dual-polarization radiating element 10 to form phased array antennas having multi-octave electrical operation with substantially the same phase center for both radiated polarizations.

Transducer 260, often referred to in the art as a balun or as an exciter, is comprised, in this embodiment, of a two-stage transformer 265. Further, as shown in FIG. 4, surface 270 is comprised of the material of dielectric material carrier 96.

Slit 280 is provided so that dipole radiating element 30 may be interlocked with notch radiating element 20. Further, as one can readily appreciate from FIGS. 2 and 4, dipole radiating element 30 is interlocked by inserting notch 20 thereinto so that slit 230 of notch radiating element 20 engages end 285 of slit 280. When the two radiating elements are thusly disposed, they will be interlocked at substantially 90° with respect to each other. Lastly, as shown in FIG. 4, RF energy is applied from RF orthogonal polarization port 60 to transducer 260 substantially at position 290.

Figure 5:
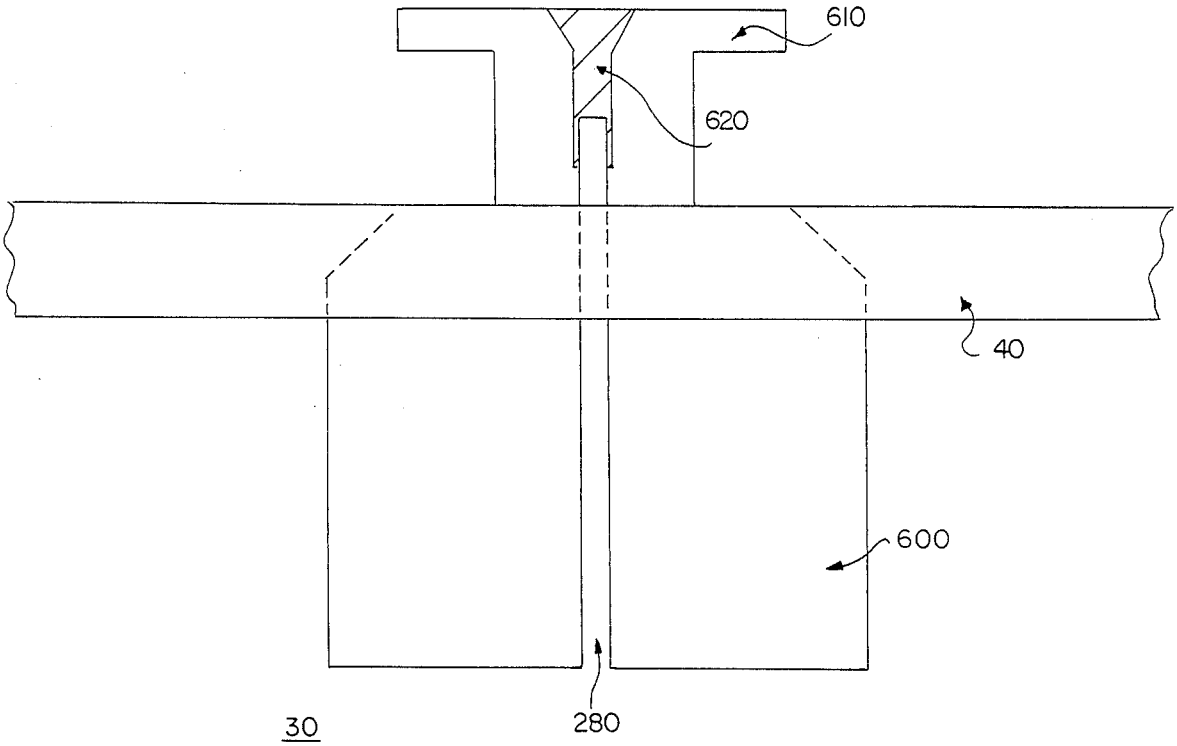
FIG. 5 shows, in pictorial form, an exterior view of the dipole radiating element of the inventive dual-polarization radiating element.

FIG. 5 shows, in pictorial form, an exterior view of dipole radiating element 30 of inventive dual-polarization radiating element 10 which corresponds to a view along the direction of arrows 200. FIG. 5 also shows where absorber 40 is disposed in relation to dipole radiating element 30.

As shown in FIG. 5, surface 600 of dipole radiating element 30 is covered with a conductor such as, for example, copper. Please note that the opposite surface of dipole radiating element 30 is substantially identical to the surface shown in FIG. 5. Surface 600 serves as part of the electrical connection when RF energy is applied to transducer 290 and, for example, a ground is applied to surface 600. Thus, the portion of dipole radiating element 30 which includes surface 600 and which extends behind absorber 40, serves as a portion of RF orthogonal polarization port 60.

Further, as shown in FIG. 5, surface 610 is conductive, for example, copper, and is formed, in accordance with methods well known to those of ordinary skill in the art, to have a shape which provides a dipole radiating element. FIG. 5 also shows an illustrative design which provides dimensions of the various components of dipole radiating element 30 in a preferred embodiment. Lastly, as is well known to those of ordinary skill in the art, surface 620 is formed from dielectric material carrier 96.

Figure 6:
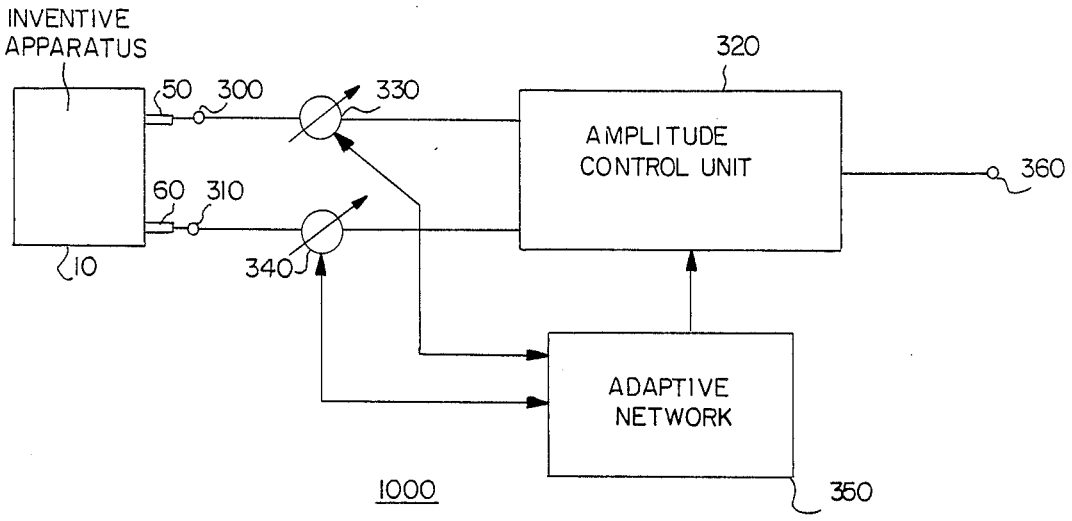
FIG. 6 shows a block diagram of a polarization control network for use in driving the inventive dual-polarization radiating element.

We will now describe two apparatus which utilize the advantageous properties of the inventive dual-polarization radiating element. For example, FIG. 6 shows a block diagram of a polarization control network 1000 for use in driving inventive dual-polarization radiating element 10 to operate as a polarization diverse antenna. Ports 300 and 310 are directly connected to RF ports 50 and 60, respectively, of inventive dual-polarization radiating element 10. In the receive function, incoming signals which are received by inventive dual-polarization radiating element 10 are coupled through ports 300 and 310 to adjustable phase shifters 330 and 340, respectively. The outputs from adjustable phase shifters 330 and 340 are applied as input to amplitude control unit 320 and adaptive network 350, respectively, to provide a total analysis of the polarization state of the input rf field. Many apparatus are well known to those of ordinary skill in the art for fabricating amplitude control unit 320 and adaptive network 350 of polarization control network 1000.

Similarly, on transmit, an input to amplitude control unit 320 via port 360 may be adjusted to produce any desired polarization of the field radiated from inventive dual-polarization radiating element 10. Further, in this configuration, adaptive network 350 can be fabricated in accordance with methods well known by those of ordinary skill in the art so that it performs the phase and amplitude adjustments automatically as an electronic servo loop to bring the input/output wavefronts in dual-polarization radiating element 10 to a desired state.

Figure 7:
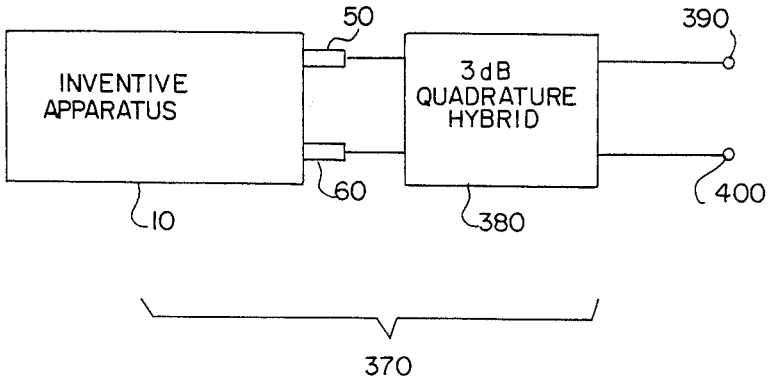
FIG. 7 shows a block diagram of a dual-circular radiator comprised of the inventive dual-polarization radiating element.

FIG. 7 shows a block diagram of dual-circular radiator 370 comprised of inventive dual-polarization radiating element 10 and 3 dB quadrature hybrid 380. In accordance with the well known properties of a 3 dB quadrature hybrid, if RF energy is applied to input terminal 390 of 3 dB quadrature hybrid 380 and the output therefrom is applied, in turn, to RF reference ports 50 and 60, respectively, of inventive dual-polarization radiating element 10, then inventive dual-polarization radiating element 10 will radiate a right-hand circularly polarized RF field. However, if instead, RF energy is applied to input terminal 400 of 3 dB quadrature hybrid 380, then inventive dual-polarization radiating element 10 will radiate a left-hand circularly polarized RF field. Further, in accordance with the well known principle of reciprocal operation, if radiation is received by inventive dual-polarization radiating element 10 the outputs at terminals 390 and 400 of 3 dB quadrature hybrid 380 will be the right-handed and left-handed circularly polarized components thereof, respectively.

Clearly, those skilled in the art recognize that further embodiments of the present invention may be made without departing from its teachings. For example, it is within the spirit of the present invention to provide a wide variety of different designs of notch radiating elements and a wide variety of different designs of dipole radiating elements.

I claim:

1. A dual-polarization radiating element comprises:

a notch radiating element disposed in a given plane and symmetrically arranged about a center line of said given plane;

a dipole radiating element disposed in a plane perpendicular to said given plane and symmetrically arranged about a center line of said perpendicular plane, said dipole radiating element being interlocked with said notch radiating element with said planes intersecting at said center lines to form a single radiating structure with the notch radiating element being of a completely different configuration than the dipole radiating element and with the phase center of said notch radiating element coinciding with the phase center of said dipole radiating element; and a structural planar absorber means which is affixed to and behind the structure of the interlocked notch radiating element and the dipole radiating element and positioned perpendicular to both of said planes such that both of said elements project in front of the absorber means.

2. The dual-polarization radiating element of claim 1 wherein the notch radiating element is a substantially planar notch radiating element of a stripline configuration having a metallized notch radiating element disposed on a planar dielectric carrier substrate.

3. The dual-polarization radiating element of claim 1 wherein the dipole radiating element is a substantially planar dipole radiating element of a stripline configuration having a metallized radiating element disposed on a planar dielectric carrier substrate.

4. The dual-polarization radiating element of claim 2 wherein the dipole radiating element is a substantially planar dipole radiating element of a stripline configuration having a metallized radiating element disposed on a planar dielectric carrier substrate.

5. The dual-polarization radiating element of claim 1 which further comprises means for applying energy to and extracting energy from the notch radiating element and the dipole radiating element.

6. The dual-polarization radiating element of claim 2 further comprising a coax to stripline transducer means coupled to said notch radiating element.

7. The dual-polarization radiating element of claim 6 wherein said transducer means includes a three stage transformer coupled to a tuning reactance.

8. The dual-polarization radiating element of claim 3 further comprising a coax to stripline transducer means coupled to said dipole radiating element.

9. The dual-polarization radiating element of claim 8 wherein said transducer means coupled to said dipole radiating element includes a two stage transformer.

* * * * *